US005213649A

United States Patent [19]

Sepavich et al.

[11] Patent Number: 5,213,649

[45] Date of Patent: May 25, 1993

[54] APPARATUS FOR RECEIVING AND CUTTING A CONTINUOUS WEB

[75] Inventors: David Sepavich, Dalton; William M. Stone, Lenox, both of Mass.

[73] Assignee: Beloit Technologies, Inc., Wilmington, Del.

[21] Appl. No.: 597,145

[22] Filed: Oct. 15, 1990

[51] Int. Cl.[5] ..... B65H 35/02

[52] U.S. Cl. ..... 156/380.7; 156/256; 156/259; 156/272.8; 219/121.67; 219/187; 242/56 B; 242/56 R; 242/56.3

[58] Field of Search ..... 156/187, 256, 259, 267, 156/272.8, 380.7; 242/56 B, 56 R, 56.3; 219/121.67, 121.64, 121.72

[56] References Cited

U.S. PATENT DOCUMENTS

| | | | |
|---|---|---|---|
| 3,365,992 | 1/1968 | Dreher | 83/614 |
| 3,582,466 | 6/1971 | Quirk | 428/136 |
| 3,805,652 | 4/1974 | LaLonde et al. | 83/169 |
| 3,918,654 | 11/1975 | Okubo et al. | 242/56 R |
| 4,345,722 | 8/1982 | Kuhn | 242/56 R |
| 4,368,855 | 1/1983 | Schönmeier et al. | 242/56 R |
| 4,408,727 | 10/1983 | Dropczynski | 242/56 R |
| 4,419,820 | 12/1983 | Stumpf | 219/121.67 |
| 4,422,588 | 12/1983 | Nowisch | 156/259 |
| 4,648,928 | 3/1987 | Ales | 156/177 |
| 4,675,497 | 6/1987 | Pearl et al. | 219/121 |
| 4,914,997 | 4/1990 | Belvederi | 83/156 |
| 4,928,838 | 5/1990 | Imamura | 219/121.69 |

FOREIGN PATENT DOCUMENTS

| | | |
|---|---|---|
| 968824 | 9/1964 | United Kingdom . |
| 2188911 | 10/1987 | United Kingdom . |

*Primary Examiner*—Robert A. Dawson
*Assistant Examiner*—David Reifsnyder
*Attorney, Agent, or Firm*—Dirk J. Veneman; Raymond W. Campbell; Gerald A. Mathews

[57] ABSTRACT

An apparatus and method for cross-cutting a traveling web of material, such as paper, while winding the traveling web into successive rolls of a specified diameter includes a laser, a pair of spaced adhesive applicators and energy means for activating the adhesive to change it from an essentially inert to a web adhesive state. A pair of horizontally arrayed drums support a core on which the traveling web is wound. Upstream of the core, over the lower periphery of one of the drums, the on-coming web has its drum-supported surface exposed to a transversely moveable laser which cuts the web transversely to its direction of travel. Upstream of the transversely actuated laser are a pair of adhesive applicator nozzles which are spaced in the web traveling direction and movable transversely with the laser. An energy means is mounted between the adhesive nozzles and laser to activate the adhesive sprayed by the nozzles. The traveling web can, thus, be severed by the laser and have its trailing edge glued to the web roll being wound while the leading edge of the severed web can be glued to a new core inserted in the winder between the drums.

6 Claims, 3 Drawing Sheets

APPARATUS FOR RECEIVING AND CUTTING A CONTINUOUS WEB

BACKGROUND OF THE INVENTION

1. Field of the Invention

This invention relates to winders for the continuous production of wound rolls of traveling web material, such as paper. More particularly, this invention relates to apparatus for severing the web in the cross-machine direction while applying adhesive to both the trailing edge of the web being wound into a roll and to the leading edge of the severed web to be wound into a new roll. Still more particularly, this invention relates to a web cross-cutting apparatus for use in conjunction with a winder on a papermaking machine, which apparatus utilizes a laser.

2. Description of the Prior Art

The winder on a papermaking machine receives the on-coming traveling paper web and winds it into a wound roll by attaching the leading edge of the web to a core, which may comprise a metal or paper board spool. The portion of the web trailing from a previously wound roll must be severed in the cross-machine direction before a new roll can be wound by attaching the web to the next core.

Heretofore, the web in a winder was severed in a variety of ways. The web could be slashed by a sharp knife wielded by an operator; it could be snapped off by the tension produced between the wound roll being removed from the winder while the on-coming web was being turned in the opposite direction over a newly inserted core supported by the winder drum, or drums; the web could be severed by a transversely extending knife which was moved against a taut span of the web, or over the web against the surface of a drum and either projected through the web over a slot in the drum surface or held against the drum surface and severed by cutting action or tension against the drum.

All of the prior methods of severing the paper web in a winder operate satisfactorily, but each method and apparatus has its own shortcomings and inefficiencies. In the case where an operator uses a knife, or razor, to manually slash the web across the width of the machine, the machine must be stopped for as long as it takes a person to traverse the width of the web at a location upstream or downstream from the wedge space between the drums. Besides the time involved and the danger of having personnel moving across the width of the machine, the web is not severed in a very straight path and there is a trailing length of paper which hangs loosely after being severed which must either be glued by hand to be attached to the wound roll, or trimmed from an upstream location which has been glued to the wound roll. Also, since the web is severed by hand, the exact location of the severance cannot be known in advance so the leading edge of the severed web either cannot have an adhesive applied automatically, or cannot easily have an adhesive applied to attach it to the next core.

In the case where the web is snapped off from a wound roll, the break profile of the severed web is almost always very ragged and results in wasted paper on both the trailing end of the wound roll and at the leading end of the web to be wound on a new core. Such an unpredictably shaped severance of the web also presents problems in applying an adhesive to both the leading and trailing edges of the severed web.

In the case of using a transversely extending knife, the knife blade usually bears against a winder drum, or the winder drum must be provided with cooperating longitudinally extending notches to accommodate the penetration of the blade through the web. In either case, the drum against which the blade bears must either be notched, which is costly, or is susceptible to being scored due to the frequent contact with the blade. If the severance is effected by moving the blade against a taut span of the web, the exact location of the cut is unpredictable and adhesive cannot be easily and automatically applied to the trailing and leading edges of the unsupported web since it cannot be known in advance where those edges will be located.

SUMMARY OF THE INVENTION

The structural deficiencies and operating inefficiencies of the prior types of apparatus for cross-cutting the web, gluing the severed edge to the wound roll and attaching the leading edge of the on-coming web to a core have been obviated by this invention.

In the preferred embodiment of this invention, the core, and paper roll being wound, is supported in the notch area between, and upon, the drums of a conventional two-drum winder. The on-coming paper web is disposed over the lower periphery of one of the drums and is guided upwardly over the drum surface and over the core to be wound into a paper roll. Beneath the drum over which the paper web is supported, is a traversing carriage on which is mounted a pair of spaced (that is, spaced in the direction of web travel) spray nozzles for spraying parallel rows of an adhesive on the web transversely thereof in the longitudinal direction of the support drum.

Positioned downstream of the adhesive applicator nozzles on the carriage in the transverse direction of adhesive application, is an energy device, which may take any of several forms depending on the type of adhesive used, which activates the essentially inert adhesive to a bonding state, or condition, such that the adhesive readily adheres to another surface and becomes dried or inert a short time later after being pressed against the wound roll or new core. In this invention, the term "glue" will generally be used as a verb, and the term "adhesive" will be used as a noun.

Further downstream on the carriage, in the direction of transverse carriage travel, is a laser whose beam is directed in a relatively narrow space between the defined stripes of adhesive applied immediately upstream of the laser and energy device. The laser cuts the web cleanly without producing dust or ragged edges. There is no fire hazard due to the extremely small laser beam width and the concomitant short annular length of the opening produced by the laser in the web. Thus, the surface of the web bordering the laser cut is too small for atmospheric oxygen to initiate or sustain combustion.

It is contemplated that the web can be either moving or stationary when the web is cut. Thus, if the web is moving, the adhesive will be applied, and the cut made, in a relatively uniform line which produces a slightly slanted edge profile, or very shallow spiral pattern, of the severed web on the wound roll of paper. Of course, if the winder drums are halted before the web is severed, which is the standard procedure, the severed web will be in a perfectly straight line extending transversely of the web and longitudinally of the wound roll axis of revolution. Since the traversing speed of the carriage is intended to be relatively high, even if the on-coming paper web is not halted during the web severing process, the amount of paper potentially wasted along the length of the web beginning at one end of the roll where the laser cut is initiated and ending at the other end of the roll where the laser cut ends, is relatively small. If the web has been halted when the cross-cut is made, there is little, if any, wasted paper. In either case, the adhesive is applied neatly and uniformly to both the trailing and leading edges of the severed web.

The combination of several operating parameters, such as the traversing speed of the laser, the laser power, the caliper of the web to be severed, and the steel construction of the winder drums, combine to result in the web being severed without damaging or excessively heating the supporting winder drum. Further, the winder drums neither require nor utilize any special surface preparation or construction.

The invention does not require active participation by an operator and results in both the trailing edge of the paper web being wound onto a roll and the leading edge of the on-coming paper web having adhesive applied uniformly and precisely so that they can be secured to the wound roll and new core, respectively, substantially automatically during the winding process.

Accordingly, it is an object of this invention to provide a method and apparatus for cleanly cross-cutting a web being wound into a roll.

Another object of the invention is to provide a method and apparatus for severing the web in the cross-machine direction and accurately applying a stripe of adhesive to both the trailing and leading edges of the severed web.

Another object of this invention is to provide a method and apparatus for severing a web of paper in the cross-machine direction utilizing a laser.

An advantage and feature of this invention is the provision of adhesive application means, adhesive treatment means and web severing means which are transversely moveable together.

An object, feature and advantage of this invention is to provide a method and apparatus for severing the web, and applying adhesive to the trailing and leading edges of the severed web and activating the adhesive such that the trailing web edge can be cleanly attached to the wound roll and the leading web edge can be cleanly attached to a new core.

Another object, feature and advantage of this application is the use of adhesives which become activated only upon exposure to a specific type of energy such that adhesive not exposed to the energy does not adhere the web, or cause the web to tear or smear the apparatus.

These, and other objects, features and advantages of the invention will become readily apparent to those skilled in the art upon reading the description of the preferred embodiments in conjunction with the attached drawings.

DESCRIPTION OF THE PREFERRED EMBODIMENTS

In this description, corresponding elements in the various views and embodiments will be correspondingly numbered with different letter postscripts to distinguish between the corresponding elements. Similarly, the same elements in a particular embodiment may be distinguished by the use of different prime superscripts.

Figure 1:
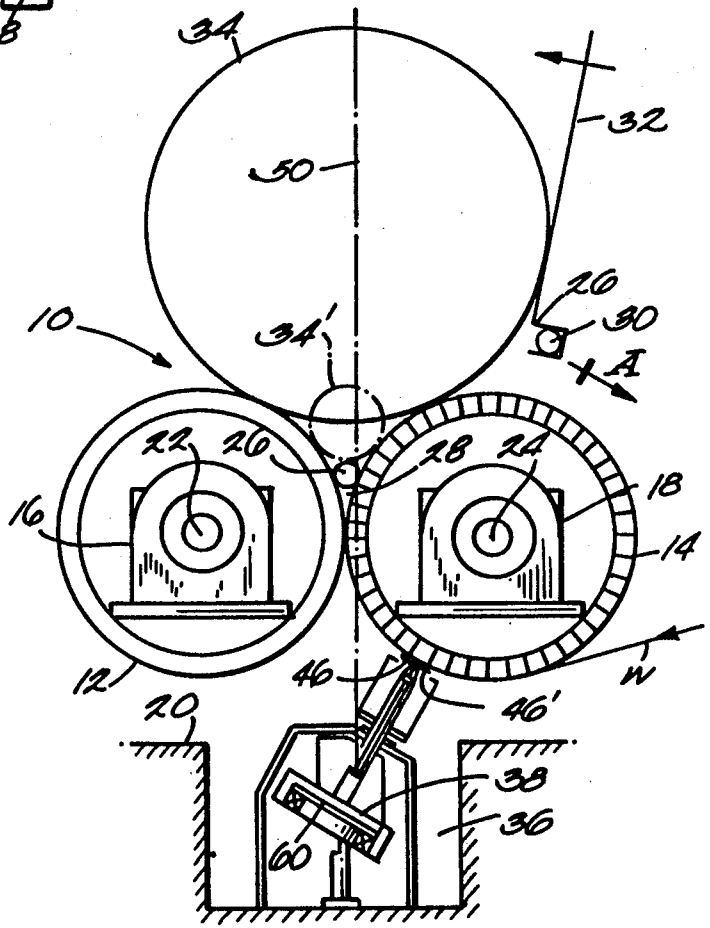
FIG. 1 is a side-elevational view of a two-drum winder and showing, somewhat schematically, a newly inserted core, a partially wound roll of paper and a wound roll of paper supported on the drums, and further showing the adhesive application and laser severing apparatus positioned beneath one of the support drums.

As shown in FIG. 1, a paper winder, generally designated 10, has two horizontally arrayed winder drums 12,14 mounted in respective bearing housings 16,18 in a frame 20 which is partially shown. The axes of rotation 22,24 of the winder drums are parallel and in a horizontal plane.

At this point, it is acknowledged that two-drum types of winders exist wherein the parallel axes of rotation of the drums are not in a horizontal plane, and some configurations exist where one or both of the drums are movable, either laterally, vertically or pivotally to provide some operating characteristic or advantage. For the purposes of this description, although the standard two-drum type of winder is preferred, the exact configuration of the winder is unimportant, and the winder could be of the two drum, three drum or even single drum type. What is significant, for the purposes of describing the invention, is that the paper roll is wound on at least one drum surface and that the web is supported while being cut. This will be described in more detail below.

A core 26 is positioned in the V-shaped notch 28 formed between the drums. While the drums are positioned close together, their surfaces are slightly spaced apart so as to rotatably support the core while preventing adhesive on the surface of the paper web W over one of the drums from contacting the surface of the other drum where it could smear its surface and possibly contact, tear and damage the web being wound into a roll.

While the core can be positioned in the notch by hand, in modern papermaking machines, new cores are usually loaded into the winder mechanically, such as by being carried in a trough 30 at the end of a pivoted, or articulated, arm 32 which also serves as the ejector of the wound roll 34. Mounted within a pit 36 beneath the winder drums is a carriage 38 which is mounted for reciprocal transverse movement parallel to the axes 22,24 of the support drums.

Figure 2:
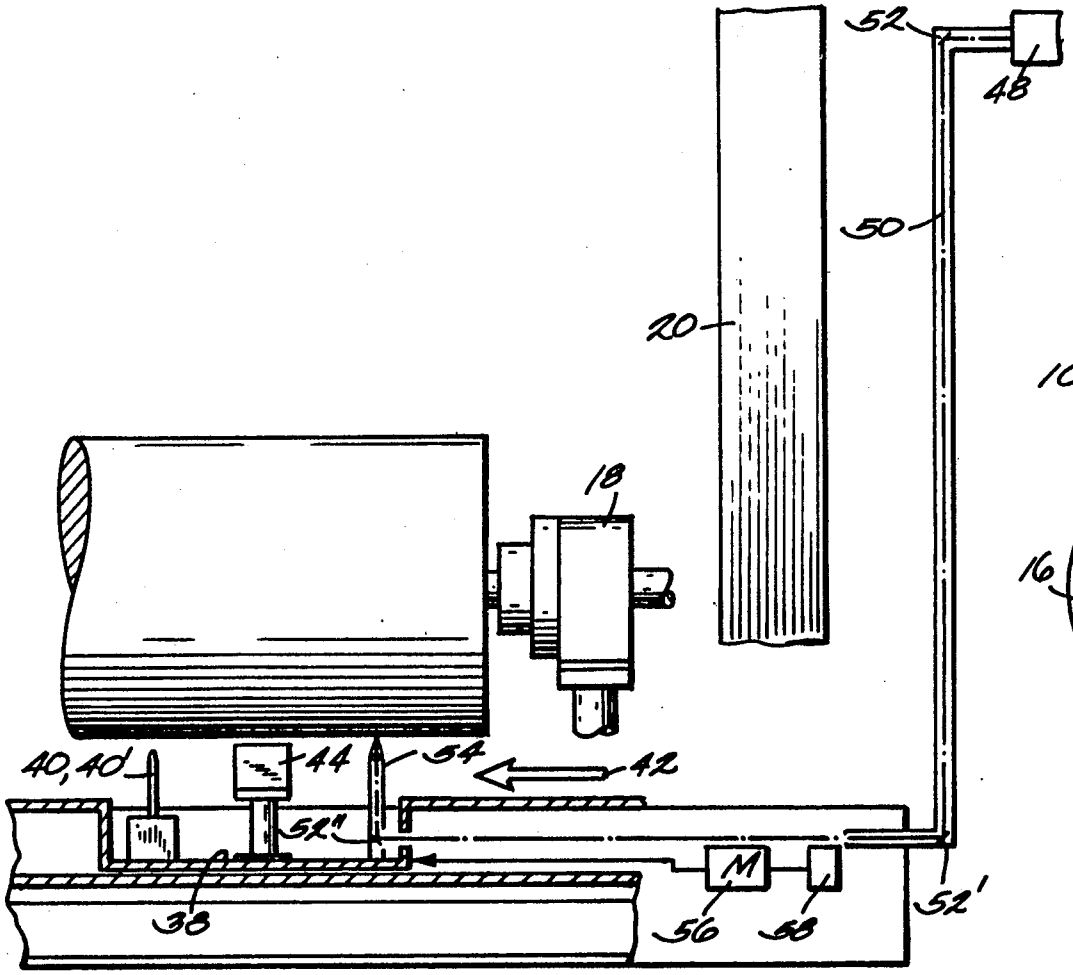
FIG. 2 is a front-elevational view along section "A'-'—"A" in FIG. 1.

As shown in FIG. 2, mounted on the carriage are a pair of spray heads, or nozzles, 40,40' which are arrayed in tandem in the machine direction, that is, the direction of web travel. Downstream, or behind, the spray nozzles, in the direction of travel across the machine as shown designated by arrow 42, is an energy device 44 for directing energy against the adhesive, which has been applied by the nozzles to the paper web in parallel stripes 46,46' (FIG. 1), to activate the adhesive to allow it to adhere to another surface, such as the wound roll of paper or a core. In this invention, the type of adhesive preferred is one which has little or no properties of adhesion until activated by an energy source, such as ultraviolet light, infrared light, electron beams, microwave, or heat. Such adhesives are known and are readily available. It is anticipated that pressure, such as provided by a nip, could also activate some types of adhesive.

As stated above, unless and until the adhesive is exposed to a source of energy, it has no effective adhesive properties. Accordingly, if non-activated adhesive gets on a drum, wound roll or core, nothing more harmful than a slight wetting is incurred. More specifically, the non-activated adhesive cannot cause the paper web to deleteriously adhere to any element to which it is not desired that adherence be made.

Downstream of the source 44 of energy, a laser 48 is mounted on the carriage. The laser can be any of several different types, such as a radio frequency excited $CO_2$ laser. The type of laser used is compatible with the kind of energy needed to activate the adhesive. Further, the power of the laser is made different for each specific application depending on operating parameters, such as the caliper and density of the paper web being wound, the speed of the web, and even the number of individual lasers used in the event that more than one laser is focused at the same spot on the traveling web. As a rough criterion, it has been determined that 60 watts/mil/1000 ft/min. would provide adequate laser power for cutting tissue grades of paper. Other approximate so-called bench mark power ratings determined by trials are as follows: newsprint—90 watts/mil/1000 ft/min.; coated board—94–98 watts/mil/1000 ft/min.; pulp—9-8–125 watts/mil/1000 ft/min.; gloss gravure—39–153 watts/mil/1000 ft/min.

Regardless of the laser power and speed parameters required to cut the web, it is anticipated that the speed requirements of the reciprocally moving carriage to uniformly apply the stripes of adhesive to the paper web may well pace the duty cycle of the apparatus.

FIGS. 3A, 3B, 3C and 3D illustrate three expositive embodiments of how the laser beam 50 can be applied to the paper web W to effect the cutting operation. In the embodiments shown in FIG. 3A, which is also shown in FIG. 2, a fixed laser is mounted outside of the winder drums, such as on the frame, and directs its beam 50, by means of one or more turning mirrors 52 toward the carriage 38 where a focusing optic lens 54 is mounted to focus the beam against the paper web which is supported on the surface of winder drum 14. A motor 56, which is driven by a suitable controller 58, moves the carriage 38 reciprocally beneath the paper web transversely of the winder for the width of the web longitudinally of the drum and parallel to its axis of rotation. This is done through a timing belt 60, gears 62,62' in a conventional manner which will be understood by those skilled in the art.

Figure 3A:
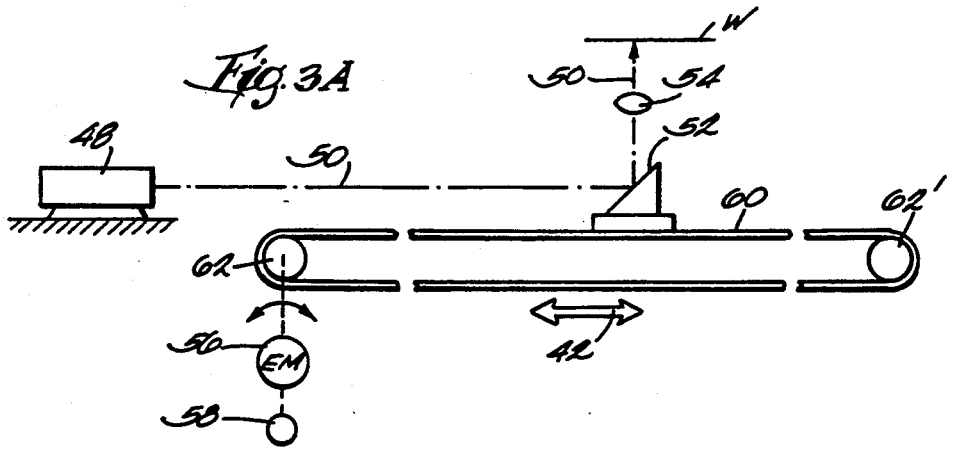
FIGS. 3A, 3B, 3C and 3D show different configurations for transversely directing the laser beam onto the web.
Figure 3B:
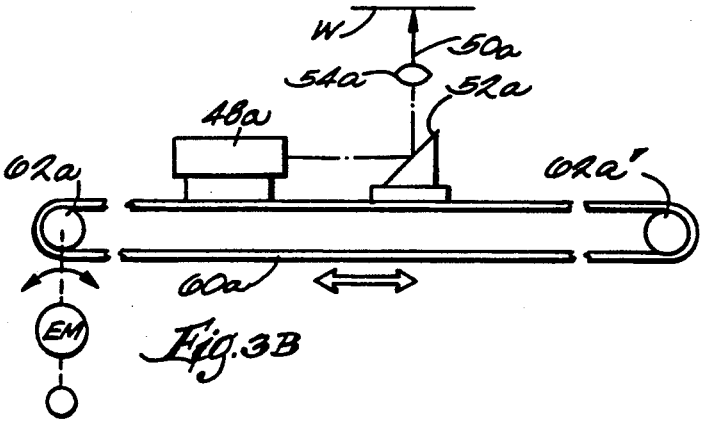

In FIG. 3B, an arrangement is shown wherein the laser **48*a* is itself mounted on the carriage 38*a* with a mirror 52*a* and lens 54*a* to turn and focus, respectively, the laser beam 50*a* to apply it to the paper web. While not shown for purposes of simplicity, the adhesive application nozzles and energy device in the embodiments shown in FIGS. 3A and 3B are the same as shown in FIG. 2. The arrangement in FIG. 3B** has the advantage of not requiring apparatus for directing the laser beam over relatively long distances and around several turns from outside the frame.

Figure 3C:
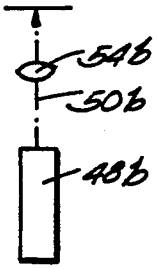

In FIG. 3C, the laser **48*b* mounted on the carriage is shown rotated 90° from its position shown in FIG. 3B**. This eliminates the need to turn the laser beam with a mirror.

Figure 3D:
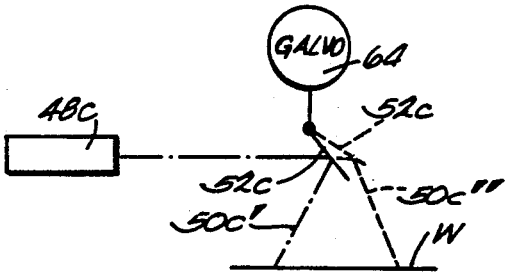

FIG. 3D illustrates, somewhat schematically, how a galvo driven device 64 can be linked to the mirror **52*c* on the carriage to change the direction of the laser beam 50*c*** and thereby control the location of the laser cut in the machine direction as the carriage moves transversely of the web. As is well-known in the electrical control art, the galvo device rotates about an axis as a function of the electrical voltage. When the voltage changes, the attitude, or rotational position, of the device, and hence the position of the mirror, changes. Similarly, when the voltage is maintained constant at a given level, the galvo, and mirror, remain in a desired position. This can be used to vary the point of laser beam impingement on the web in an infinitely variable manner.

Figure 4C:
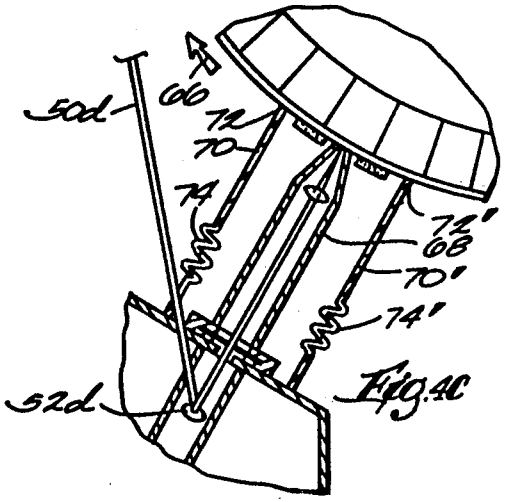
FIGS. 4A, 4B and 4C are similar side-elevational views showing the spaced adhesive application nozzles, the adhesive activating energy means and the laser head, respectively, in their operating positions over the web supported on the drum.
Figure 7B:
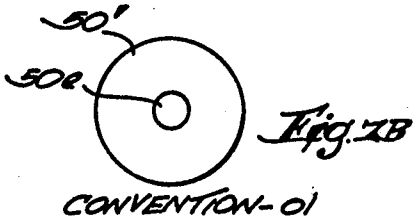
FIGS. 7A, 7B, 7C and 7D show several conventions for the laser beam pattern.
Figure 7D:
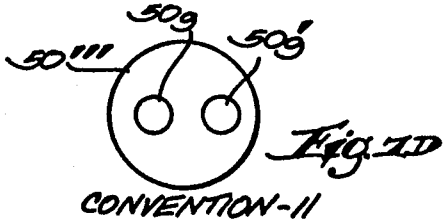
Figure 4B:
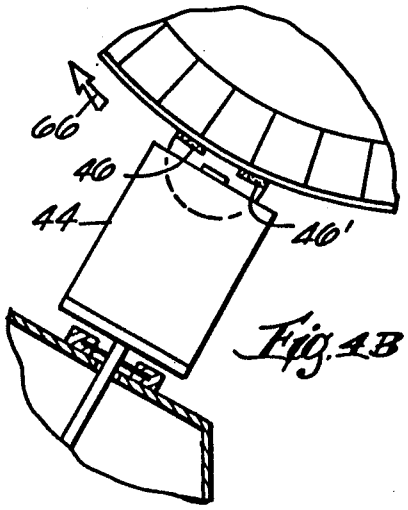
Figure 7A:
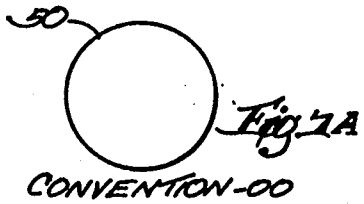
Figure 7C:
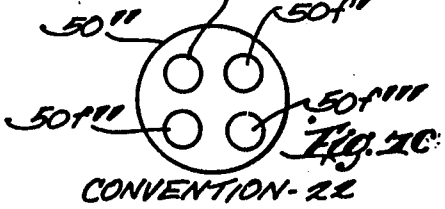
Figure 4A:
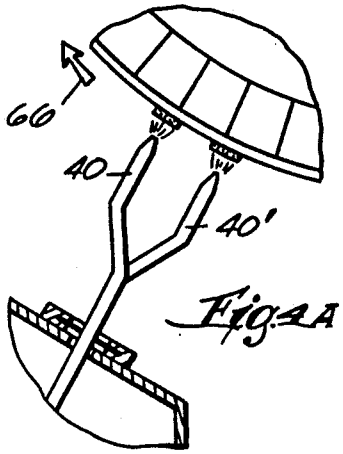

In FIG. 4A, the spray nozzles 40,40' are shown in more detail. Nozzles 40,40' are offset circumferentially in the direction 66 of drum rotation and web travel. In this configuration, they are able to spray closely spaced, distinctly defined, uniform stripes 46,46' of adhesive on the outer surface of the paper web.

As shown in FIG. 4B, a source of energy, such as ultraviolet lamp 44, is also mounted to the carriage in radially spaced adjacency to the previously applied stripes 46,46' of adhesive. The preferred types of adhesive are of the so-called energy-activated types which have essentially no adhesive properties until activated by an energy source, such as ultraviolet light. The traversing path of the energy device 44 thus activates the adhesive such that the adhesive will adhere to the next surface coming into contact with the web.

FIG. 4C illustrates a laser beam focusing apparatus 68 which utilizes a mirror 52 to receive the laser beam 50 from a source, such as laser generator 48 shown in FIGS. 2 and 3A, and reflecting the laser beam toward the web and focusing it at a point on the web surface between the previously applied stripes of adhesive. As shown somewhat schematically, shields 70,70' on either side of the focusing apparatus are also mounted to the carriage to shield the focused laser beam from both personnel and other equipment as a safety precaution. The distal ends 72,72' of the shields can be arranged to slidably bear against the web while the proximate ends can be spring loaded 74,74' to maintain their contact with the paper web.

Figure 5:
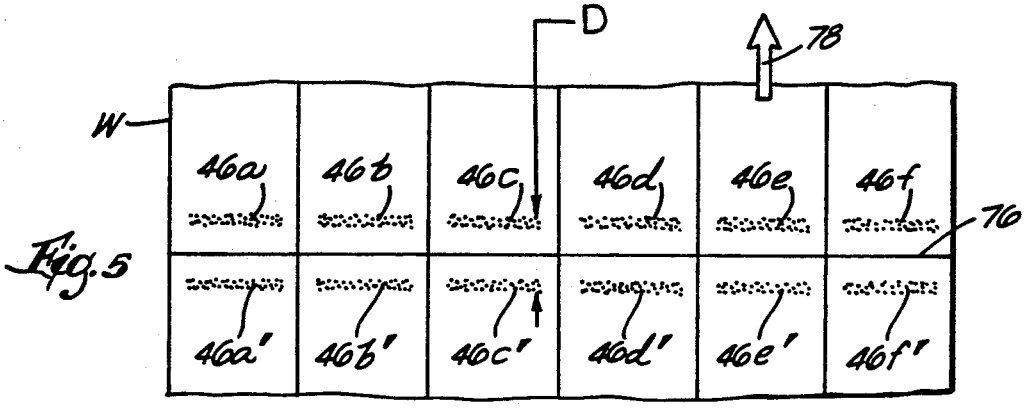
FIG. 5 is a plan view of a longitudinally and transversely slit paper web which shows the application of the adhesive on either side of the transversely extending cut in the web.

FIG. 5 shows a plan view of a paper web which has passed beyond the carriage station. The on-coming web has previously been slit longitudinally into a plurality of webs, in this case six, of smaller width. The laser cut 76 is shown extending transversely of the paper web, and the two stripes of adhesive are shown on either side of the laser cut. The stripes comprise a series of longitudinally extending segments 46a,46b,46c,46a',46b',47c' . . . which are interrupted at the slits extending longitudinally in the direction of sheet travel 78.

Figure 6:
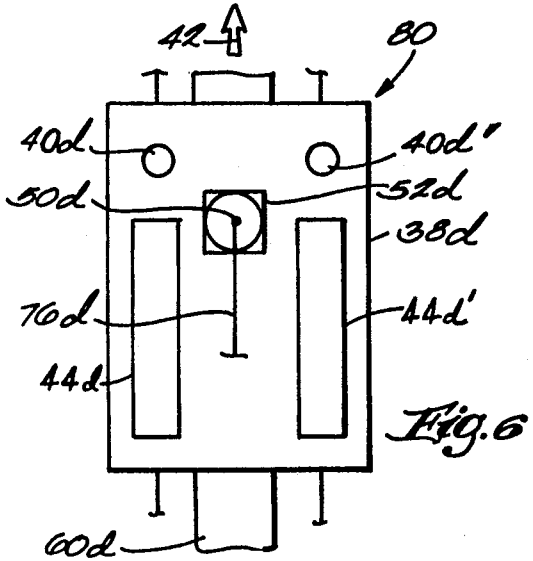
FIG. 6 is a top plan view of an optics, spray nozzles and adhesive activation system mounted on a carriage.

FIG. 6 shows a top view of an optical, spray nozzle and energy device system 80 as it would be viewed from the surface of the paper web to be transversely cut, have adhesive applied to either side of the cut and have the adhesive activated by the application of energy to it. The apparatus is mounted to a carriage 38d traveling in the direction of arrow 42, by being attached to a moving timing belt 60d which is operable as described previously. A turning mirror 52d directs the laser beam 50d to sever the web with a cut 76d extending parallel to the direction of carriage travel. On either side of the cut, a spray nozzle 40d,40d' applies a stripe of adhesive immediately beneath the on-coming energy devices 44d,44d' which expose the adhesive stripes to energy such as, for example, infrared light. This apparatus thus produces the type of cross-cut 76d in the paper web straddled by the adhesive stripes 46a,46b,46c,46a',46b',46c,' . . . as shown in FIG. 5.

FIG. 7 illustrates typical conventions for the laser beam pattern. The laser beam pattern used in any given application would depend on the operating parameters previously mentioned. The laser beam patterns can focus the laser wave energy in different patterns to provide different cuts, and speeds of cuts, depending on the requirements of the particular application. The convention, which describe electromagnetic field variations perpendicular to the direction of wave travel, in terms of transverse electromagnetic modes, or "TEM" modes, represents a numerical designation for the row and column, respectively, of the focused components 50a,50b,50b',50b'',50b''', for example, of the laser beam.

In operation, with reference to FIGS. 1, 2 and 3A, carriage 38 is driven by motor 56 transversely of winder drum 14. The spray nozzles, energy device and laser are directed toward the paper web W over the surface of winder drum 14 perpendicular to an imaginary plane tangent to the web supported on the winder drum. The nozzles 40,40' spray two parallel, closely spaced stripes 46,46' of adhesive transversely of the web as the carriage moves from the front of the winder to the back in the direction of arrow 42. The stripes can be interrupted, as shown in FIG. 5, as desired. The energy device 44 exposes the stripes to energy suitable to activate the particular adhesive being applied. The laser, which may be either a laser directly aimed at the paper web, such as shown in FIG. 3C, or a focusing apparatus to focus a laser beam coming from outside the carriage, such as shown in FIGS. 1, 2 and 6, directs the laser beam onto the web to cut the web in the cross-machine direction in the space between the parallel adhesive stripes.

If the winder has just been started, a core is inserted in the notch between the winder drums to receive the on-coming web. The circumference of the core is greater than the machine distance D (FIG. 5) from the leading side of the leading stripe 46 to the trailing side of the trailing stripe 46'. This ensures that the activated adhesive only contacts the surface of the core to begin the winding of the on-coming web into a paper roll 34.

In the case where a paper roll 34 has been wound and remains supported on the winder drums as shown in FIG. 1, the web is severed in the cross-machine direction and the adhesive applied and activated on the leading and trailing edges. The ejector arm 32 begins to move in the direction of arrow 33 to urge the wound roll onto drum 12. The rotation of the wound roll 34 on drum 12 moves the trailing end of the transversely cut paper web beyond the notch. At the same time, after the trailing end of the web has passed the notch, a new core 26 is dropped from trough 30 into the notch between the winder drums 12,14. The activated adhesive on the trailing edge of the severed web will attach the severed end of the web to the wound roll as it rotates over drum 12. The leading edge of the severed web then contacts and adheres to the newly inserted core and the winding of the new roll commences. This sequence is repeated to produce successive rolls of wound paper.

In this description, the term "edge" has been used to denote the border area of the severed web which has had adhesive applied to it. The end of the web is the physical beginning or ending of the web.

Clearly, variations in the apparatus can be made without departing from the spirit and scope of the appended claims. For example, the laser beam, or the mirror or focusing apparatus, can be positioned upstream or downstream of the energy device to activate the adhesive. Also, while the drums have been described as being mounted in the frame, the frame does not merely include structure extending above the floor, but includes the floor itself as well as the pit in which the carriage is disposed. Further, while the invention has been described in conjunction with a two-drum winder, which is the preferred embodiment, the apparatus could be used in conjunction with a single, or multiple, drum winder. Finally, while the preferred adhesive is of the type which is non-adhesive until activated by energy of some appropriate type, it is contemplated that the apparatus could operate with ordinary glue, which is effective without being exposed to a source of energy, so the concept of the invention is not intended to be limited by the type of adhesive used. The adhesive could also be applied in a single stripe and the laser directed to cut the web intermediate the outer edges of the adhesive stripe.

What is claimed is:

1. Apparatus for receiving and cross-cutting a traveling continuous web of material to be wound into successive rolls, with each roll initially wound onto a core and into a roll, the apparatus including:

frame means;

drum means rotatably supported in the frame means about a longitudinal axis thereof, and over the lower surface of which the web is supported as it is wound onto a core supported on an upper surface of the drum means;

carriage means, including a carriage and traversing means for moving the carriage transversely of the direction of the traveling web, the carriage means disposed beneath the web over the lower surface of the drum means;

glue means mounted on the carriage for applying adhesive on the web along a path transversely thereof;

laser means mounted on the carriage for directing a laser beam onto the web supported on the lower surface of the drum means for cross-cutting the web proximate the adhesive path in the cross-machine direction;

whereby uniformly cut trailing and leading edges of the cross-cut web are produced upstream of the core supported on the drum means for attachment to the wound roll, or a core, or both, as desired.

2. Apparatus for cross-cutting a traveling continuous web as set forth in claim 1, further including:

activation means for directing energy onto the path of adhesive to activate the adhesive into an adhesive state.

3. Apparatus for cross-cutting a traveling continuous web as set forth in claim 1, wherein:

the laser means comprises a focusing apparatus mounted on the carriage, and a laser mounted to direct a beam into the focusing apparatus which in turn directs the beam onto the web.

4. Apparatus for receiving and cross-cutting a traveling continuous web of material to be wound into successive rolls, with each roll initially wound onto a core and into a roll, the apparatus including:

frame means;

drum means, including a pair of substantially horizontally arrayed drums rotatably supported in the frame means about longitudinal axes thereof, and over the lower surface of at least one of which the web is supported, the drums being in spaced adjacency and forming a notch therebetween for receiving and rotatably supporting a core on the upper surfaces of the drams;

carriage means, including a carriage and traversing means for moving the carriage transversely of the direction of the traveling web, the carriage disposed beneath the drum means and in spaced adjacency with the web supported on the lower surface of the drum;

glue means mounted on the carriage for applying adhesive on the web supported on the lower surface of the drum along a path transversely thereof;

activation means mounted on the carriage for directing energy to the adhesive along its path on the web disposed on the lower surface of the drum for activating the adhesive to a web adhering state;

laser means mounted on the carriage for cross-cutting the web disposed on the lower surface of the drum adjacent the adhesive path in the cross-machine direction;

whereby uniformly cut trailing and leading edges of the cross-cut web are produced upstream of the core supported on the drums for attachment to the wound roll, or a core, or both, as desired.

5. Apparatus for cross-cutting a traveling continuous web as set forth in claim 4, wherein:

the glue means comprises a pair of nozzles which are spaced in the direction of the traveling web for applying a pair of spaced parallel stripes of adhesive on the web;

the laser means includes a laser beam directed on the web in the space between the adhesive stripes, whereby the web is cut across the machine having a trailing end with a strip of activated adhesive near its trailing edge, and a leading end having a stripe of activated adhesive near its leading edge.

6. Apparatus for cross-cutting a traveling continuous web as set forth in claim 4, wherein:

the laser means includes a laser mounted on the carriage and a mirror for directing a laser beam produced by the laser onto the web for cutting the web.

* * * * *